US007818925B2

(12) United States Patent
Benedict

(10) Patent No.: US 7,818,925 B2
(45) Date of Patent: Oct. 26, 2010

(54) STAY-IN-PLACE CONCRETE FOOTING FORMS

(76) Inventor: Bryan Benedict, 405 Gill Ave., Galion, OH (US) 44833

( * ) Notice: Subject to any disclaimer, the term of this patent is extended or adjusted under 35 U.S.C. 154(b) by 0 days.

(21) Appl. No.: 12/555,234

(22) Filed: Sep. 8, 2009

(65) Prior Publication Data

US 2010/0043325 A1 Feb. 25, 2010

(51) Int. Cl.
*E02D 31/00* (2006.01)

(52) U.S. Cl. ..... 52/169.5; 52/426

(58) Field of Classification Search ..... 52/43, 52/45, 169.5, 426, 442; 249/4, 34, 216
See application file for complete search history.

(56) References Cited

U.S. PATENT DOCUMENTS 3,562,988 A * 2/1971 Gregoire ..... 52/279
3,613,323 A * 10/1971 Hreha ..... 52/169.5
3,778,019 A * 12/1973 Stegmeier ..... 249/189
3,788,020 A * 1/1974 Gregori ..... 52/309.12
4,632,602 A * 12/1986 Hovnanian ..... 405/129.8
4,655,014 A * 4/1987 Krecke ..... 52/105
4,703,602 A * 11/1987 Pardo ..... 52/564
4,949,515 A * 8/1990 Krecke ..... 52/105
5,015,117 A * 5/1991 Pawlicki ..... 403/300
5,205,942 A * 4/1993 Fitzgerald ..... 249/3
5,216,866 A * 6/1993 Ekedal ..... 52/677
5,466,092 A * 11/1995 Semenza et al. ..... 405/45
5,475,950 A * 12/1995 Palmer ..... 52/169.5
5,535,556 A * 7/1996 Hughes, Jr. ..... 52/169.5
5,634,741 A * 6/1997 Tremblay et al. ..... 405/43
5,927,041 A * 7/1999 Sedlmeier et al. ..... 52/836
6,151,856 A * 11/2000 Shimonohara ..... 52/426
6,409,422 B1 * 6/2002 Mittermaier et al. ..... 404/8
6,629,681 B1 * 10/2003 Miller et al. ..... 249/3
7,303,361 B1 * 12/2007 Lane ..... 405/287
2005/0223669 A1 * 10/2005 Cymbala et al. ..... 52/426
2006/0239781 A1 * 10/2006 Kliefoth et al. ..... 405/229
2007/0196184 A1 * 8/2007 Hammer et al. ..... 405/284

* cited by examiner

*Primary Examiner*—Gay Ann Spahn
(74) *Attorney, Agent, or Firm*—Mueller Smith & Okuley, LLC

(57) ABSTRACT

A stay-in-place concrete footings form is used for forming a concrete footing between a spaced-apart pair of the stay-in-place concrete footings forms. Each concrete footing form is elongate and has a cavity inside the form. Each form has a pair of elongate sides wherein openings are formed in the elongate sides to permit water to flow into the cavity. Each form has a dovetail pin or dovetail slot formed along the lengthwise extent of both sides of the form. The dovetails permit clamps, having a mating dovetail slot or dovetail pin, to be clamped to the form for anchoring the form to the ground with a stake carried by the clamps.

9 Claims, 5 Drawing Sheets

FIG. 1
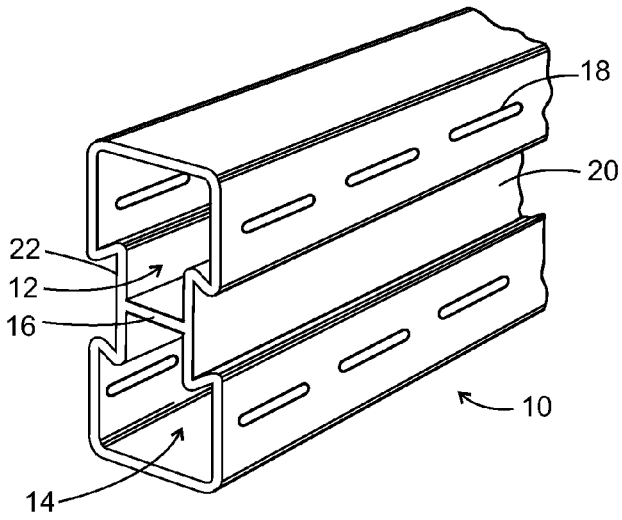
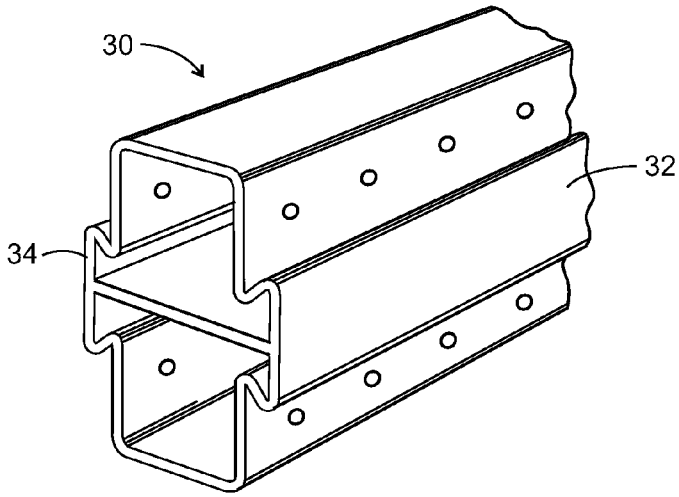
FIG. 2
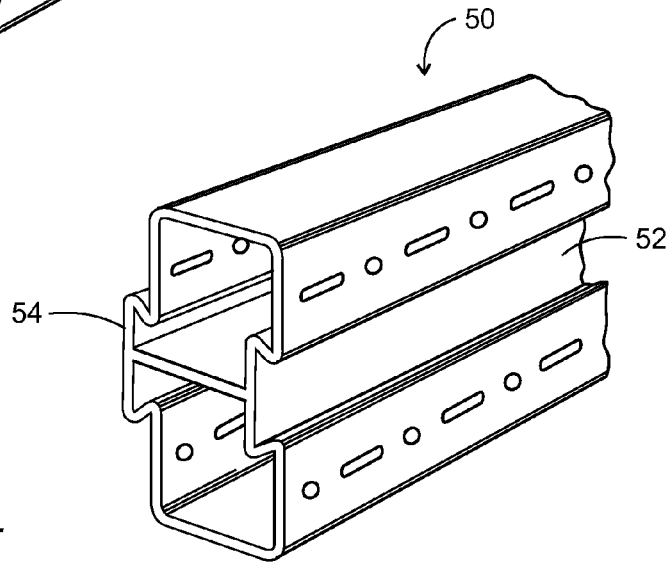
FIG. 3

FIG. 15
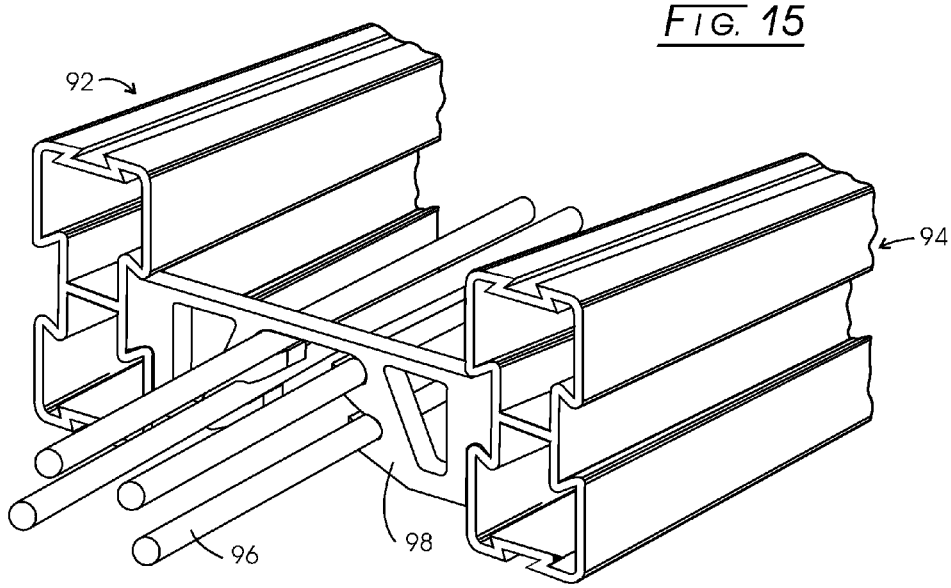
FIG. 16
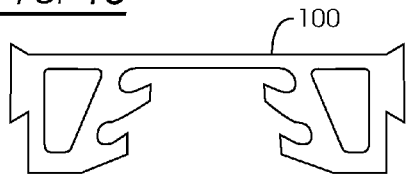
FIG. 18
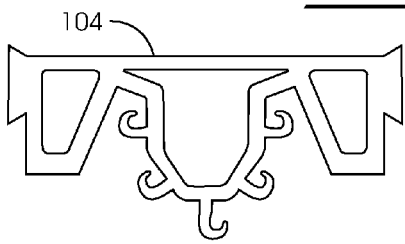
FIG. 17
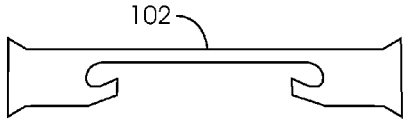
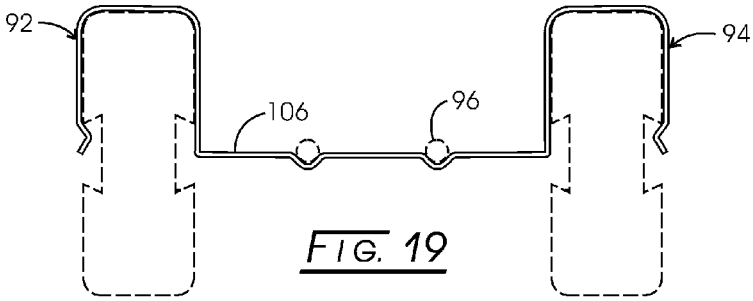
FIG. 19

STAY-IN-PLACE CONCRETE FOOTING FORMS

CROSS-REFERENCE TO RELATED APPLICATIONS

This application claims benefit of application Ser. No. 11/810,646, filed Jun. 6, 2007, entitled "Stay-in-place Concrete Footing Forms"; and provisional application Ser. No. 60/812,889 filed on Jun. 12, 2006, entitled "Stay-in-place Concrete Footing Forms"; and provisional application Ser. No. 60/879,384 filed on Jan. 9, 2007, entitled "Stay-in-place Concrete Footing Forms".

STATEMENT REGARDING FEDERALLY SPONSORED RESEARCH

Not applicable.

BACKGROUND OF THE INVENTION

The present invention generally relates to forms for pouring concrete footers and more particularly to a form system that also provides water drainage as a continuous drain tile.

Stay-in-place concrete footing forms are commercially available and used in the home construction industry. One such form system by Alton F. Parker is based on hollow forms that function to also drain water (see U.S. Pat. Nos. 5,224,799, 5,120,162, for example). Another such form system by Patrick S. Pawlicki uses a dovetail in one side of the form for permit the forms to be staked to the ground. An elaborate connection system is proposed to join adjacent such forms (see U.S. Pat. No. 5,015,117).

Despite the availability of these concrete footer form systems, there still is a need in the art for improvements thereto. The present invention is one such improved concrete footer form system.

BRIEF SUMMARY OF THE INVENTION

A stay-in-place concrete footings form is used for forming a concrete footing between a spaced-apart pair of the stay-in-place concrete footings forms. Each concrete footing form is elongate and has a cavity inside the form. Each form has a pair of elongate sides wherein openings are formed in the elongate sides to permit water to flow into the cavity. Each form has a dovetail pin or dovetail slot formed along the lengthwise extent of both sides of the form. The dovetails permit clamps, having a mating dovetail slot or dovetail pin, to be clamped to the form for anchoring the form to the ground with a stake carried by the clamps.

Advantages of the present invention include the ability to weep water from the soil surrounding the forms by the hollow space within each form. Another advantage is the ability to be staked into the ground via clamps designed to mate with the dovetails formed along the lengthwise extent of each form. These and other advantages will be readily apparent based on the disclosure set forth herein.

BRIEF DESCRIPTION OF THE DRAWINGS

For a fuller understanding of the nature and advantages of the present invention, reference should be had to the following detailed description taken in connection with the accompanying drawings, in which:

FIG. 1 is a perspective view of the stay-in-place concrete footings form;

FIG. 2 is a perspective view of an alternative embodiment of the stay-in-place concrete footings form;

FIG. 3 is a perspective view of a further embodiment of the stay-in-place concrete footings form;

FIG. 15 shows the placement of rebar between two adjacent forms with a mask or clip capturing the rebar;

FIGS. 16-18 show additional rebar mask or clip designs; and

FIG. 19 is a simplified end view of adjacent, spaced-apart forms similar to those shown in FIG. 15, but with an over the shoulder metal spring rebar clip.

Figure 4:
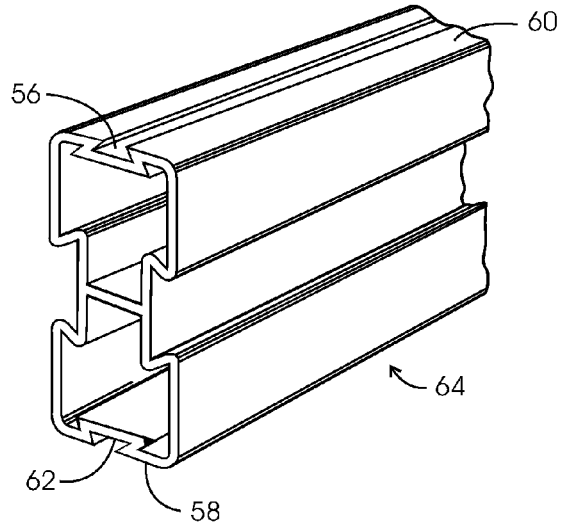
FIG. 4 is a perspective view of another embodiment of the stay-in-place concrete footings form wherein a dovetail is formed along the top and bottom thereof.

The drawings will be described in further detail below.

DETAILED DESCRIPTION OF THE INVENTION

Referring initially to FIG. 1, a section of a stay-in-place concrete footings form, 10, is shown in perspective view. Form 10 is of thin-wall construction with a pair of hollow cavities, 12 and 14, separated by an elongate central wall, 16, which provides additional structural integrity. Along the lengthwise extent of both sides of form 10 are weep or draining slots, exemplified by a slot, 18. Such slots permit water that accumulates and/or is present adjacent to form 10 to drain into cavities 12 and 14 and thence into a drain or other conveyance. Such slots aid in moving water away from the foundation of the structure built atop the footers formed with the disclosed forms.

It will be understood that the contractor will use a pair of such disclosed forms spaced-apart a suitable distance for pouring concrete between such spaced-apart forms for forming a conventional concrete footer, typically reinforced with rebar or other reinforcement. The disclosed forms are stay-in-place in that they are not removed after the concrete footer cures.

In order to ensure that form 10 stays in place before, curing, and after the concrete footer is poured, a pair of dovetails slots, 20 and 22, is formed along the lengthwise extent of both sidewalls of form 10. Such dovetails can be used in connection a mating dovetail pin carried by a clamp, as disclosed in U.S. Pat. No. 5,015,117, cited above, in order to attached a stake driven into the ground and carried by the clamp. The precise shape of the dovetail pins and slots is not important, as common dovetails, lap dovetails, or other mating configuration can be used for connection purposes, as disclosed herein.

The dovetail pin or slot along the concrete footer side of the disclosed forms can be "locked" to the concrete footer, which surrounds a dovetail pin or fills a dovetail slot. Such positive locking may even dispense with the need for the clamps and stakes. The disclosed concrete footings form design, however, permits the use of conventional clamps and stakes along with the concrete lock to ensure that the form stays in place during the concrete pour, during the curing of the concrete, and after the concrete footer cures.

Referring now to FIG. 2, a form, 30, is seen to carry a pair of dovetail pins, 32 and 34, along its lengthwise extent. Again, on such dovetail pin is locked to the concrete while opposite dovetail pin 34 can be secured to a clamp designed with a mating dovetail slot. Form 30 also uses holes to accommodate water to flow to its interior. Slots, holes, or apertures of any configuration, then can be formed into the novel form in accordance with the disclosure set forth herein.

Referring now to FIG. 3, a form, 50, has a lengthwise dovetail slot, 52, and an oppositely disposed lengthwise dovetail pin, 54, for mating with the concrete on one side (either side) and for attaching to a clamp on the other (either) side. Form 50 uses both holes and slots.

Figure 5:
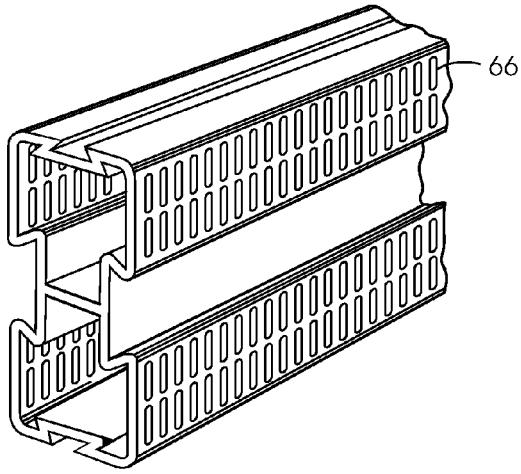
FIG. 5 is a perspective view of the stay-in-place concrete footings form of FIG. 4 having slots formed along the side thereof.

Referring now to FIG. 4, dovetail slots, 56 and 62, have been formed along the top surface, 60, and bottom surface, 58, of a form, 64. Thus, the disclosed concrete footings form has the design flexibility of using dovetail pins, dovetail slots, or a combination of dovetail pins and dovetail slots in any combination on the sidewalls, top wall, and bottom wall. FIG. 5 shows a series of vertical slots, such as a slot, 66, formed in the sidewalls of the form, such as described in connection with FIGS. 1-3. Again, the pattern of apertures and their shape is unimportant and can be left to the forms designer and/or manufacturer to implement. Of importance is that the disclosed stay in place forms function to move water away from the foundation after the structure is formed, while functioning as a conventional form for pouring concrete footers. Again, a unique multi-purpose form is disclosed.

Figure 6:
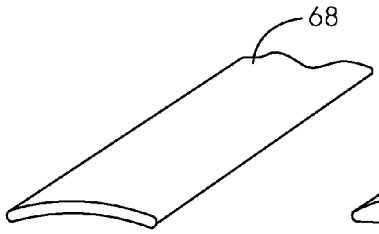
FIGS. 6-8 are partial perspective views of different splines adapted to be lodged in the dovetails of the forms in FIGS. 4 and 5.
Figure 7:
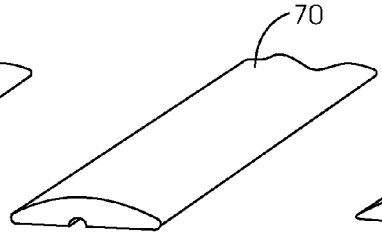
Figure 8:
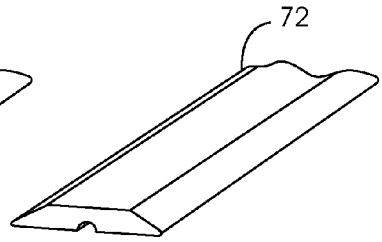

FIGS. 6-8 depict three different designs of splines, 68, 70, and 72, which splines are adapted to be placed in dovetails 56 and 62 of form 64 illustrated in FIG. 4. A variety of different spline designs will be readily apparent to the skilled artisan.

Figure 9:
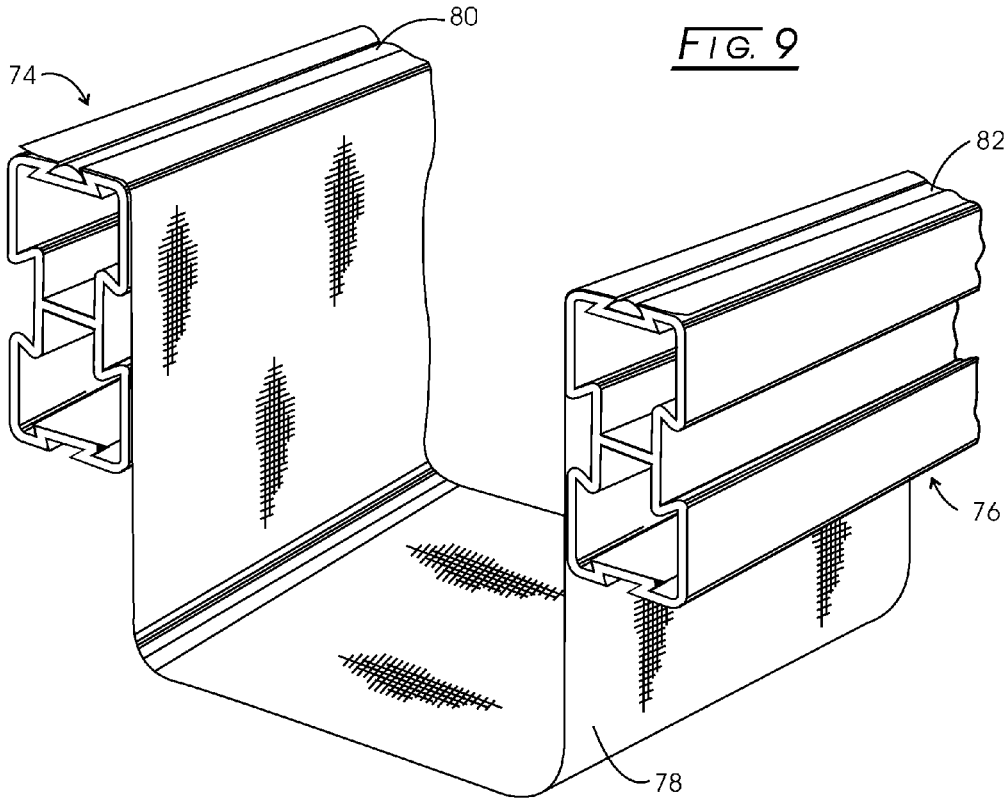
FIG. 9 is a perspective view of two adjacent stay-in-place concrete footings form of FIG. 4 having fabric spread therebetween.

FIG. 9 details the use of the disclosed splines. That is, a pair of adjacent forms, 74 and 76, can be spaced an appropriate distance apart and a fabric, 78, placed between and over the forms. The space between forms 74 and 76 will be filled with concrete, and optionally rebar, for forming a concrete footer. Fabric 78 is held in place with splines, 80 and 82, which are placed, respectively, in the dovetail slots formed along the top of form 74 and form 76.

Figure 10:
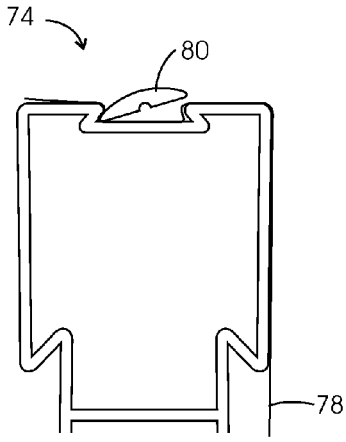
FIGS. 10-12 are end view of the stay-in-place concrete footings forms of FIG. 9 showing the placement of the splines of FIGS. 6-8 for retention of the fabric.
Figure 11:
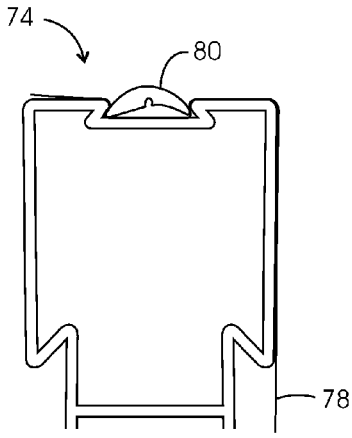
Figure 12:
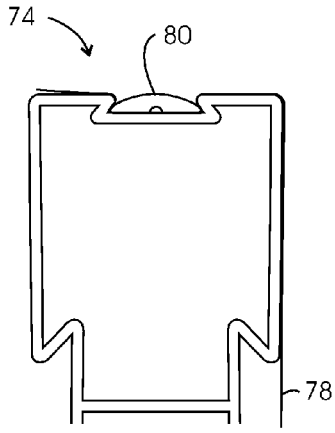

FIGS. 10-12 sequentially detail the spline placement method used to capture fabric 78 for a spline, 80, for form 74. The same method can be used to capture fabric 78 in form 76. Fabric 78 can be formed from plastic or other appropriate material, for example, for containing water. Slots, clips, and/or other attachment means also can be used for retaining the liner in place in addition to the disclosed splines and dovetails. Fabric 78 is relatively thin such that desirably is permits concrete to fill in interior dovetail slots formed in forms 74 and 76 in FIG. 9.

Figure 13:
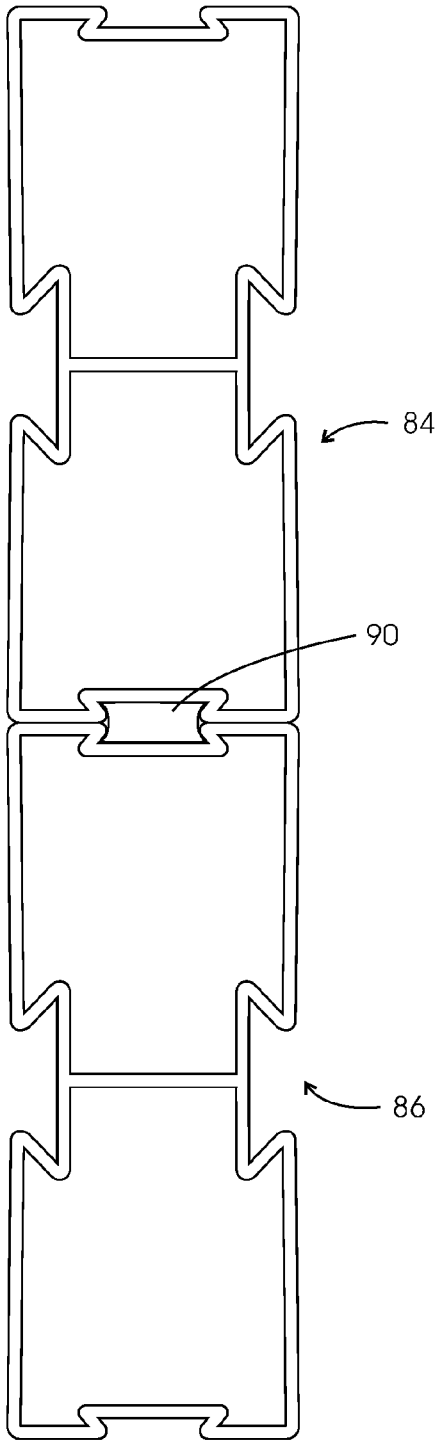
FIG. 13 is an end view of two stay-in-place concrete footings forms stacked atop each other.
Figure 14:
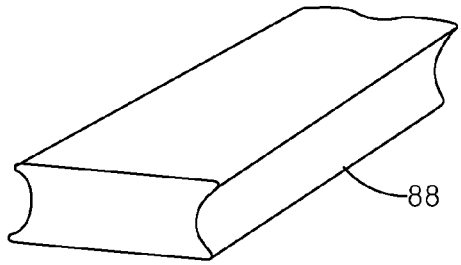
FIG. 14 is a partial perspective view of a lock for securing the two forms in FIG. 13 together using their dovetails.

For obtaining additional concrete footer height, the disclosed concrete footer forms can be stacked atop each other, as illustrated in FIG. 13 for forms, 84 and 86. In order to secure forms 84 and 86 together, a lock, 88 (see FIG. 14), can be placed in the cavity, 90, formed by the adjacent dovetail slots in forms 84 and 86. Lock or spline 88 can be provided in a variety of configurations so long as the stacked forms are secured together during the concrete footer pour.

FIG. 15 shows a pair of forms, 92 and 94, in place for pouring a concrete footer. In order to secure the rebar, such as a representative rebar, 96, a mask or clip, 98, is designed in such a pattern as to retain the rebar in the desired location within the footer to be poured. Mask or clip 98 can be retained in place by its outer ears that snugly fit within the side dovetail slots in forms 92 and 94. A plurality of such similarly or differently designed masks or clips can be placed along the extent of forms 92 and 94 at appropriate intervals. Each mask or clip has a pattern of notches in which the rebar snugly fits. FIGS. 16-18 show different representative designs of for clips, 100, 102, and 104. It will be appreciated many additional patterns can be envisioned and are useful in accordance with the present disclosure.

FIG. 19 shows an end view of forms 92 and 94 from FIG. 15, but with a metal spring clip, 106, supporting rebar, 96, and additional rebar, if desired. Metal spring clip 106 fits over the tops of forms 92 and 94 by press fitting. Slight detents at the ends of spring clip 106 fit into the outer dovetail slots of forms 92 and 94 to hold it in place. The tips of spring clip 106 have ears that protrude outwardly slightly to facilitate removal of spring clip 106, if required. The design of spring clip 106 make it movable anywhere along the entire extent of forms 92 and 94. The location of rebar 96 vertically above the ground can be determined and controlled by the height of the inner legs of spring clip 106 as they extend downwardly from the top of forms 92 and 94.

While the invention has been described with reference to various embodiments, those skilled in the art will understand that various changes may be made and equivalents may be substituted for elements thereof without departing from the scope and essence of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. A stay-in-place concrete footings form, which comprises:

an elongate, hollow form having a lengthwise extent, a pair of cavities separated by an elongate central wall inside said form, and having a top side, a bottom side, and a pair of elongate sides, a first side of said pair of elongate sides being an inner side and a second side of said pair of elongate sides being an outer side, wherein openings are formed in said first side and said second side of said pair of elongate sides to permit water to flow into the cavities;

said elongate, hollow form having a dovetail pin or dovetail slot formed along the lengthwise extent of said first side and said second side of said pair of elongate sides of said elongate, hollow form and adjacent to said central wall, said dovetail pin or said dovetail slot on said second side of said pair of elongate sides permitting clamps having a mating dovetail slot or dovetail pin for clamping to said elongate, hollow form for anchoring said elongate, hollow form to the ground with a stake carried by said clamps, said dovetail pin or said dovetail slot on said first side of said pair of elongate sides permitting a rebar clip to be attached thereto, wherein a spaced-apart pair of said stay-in-place concrete footings forms are used for forming a concrete footing therebetween.

2. The concrete footings form of claim 1, wherein said first side of said pair of elongate sides has a dovetail slots formed along its lengthwise extent for mating with clamps have mating dovetail pins.

3. The concrete footings form of claim 1, formed from plastic.

4. The concrete footings form of claim 1, wherein the top side and the bottom side also have a dovetail pin or dovetail slot formed along the lengthwise extent of said top side and along the of said bottom side.

5. The concrete footings form of claim 1, having a rebar clip secured to said dovetail tip or dovetail slot of said first side of said pair of elongate sides.

6. The concrete footings form of claim 5, wherein said rebar clip is formed from one or more of plastic or metal.

7. A concrete footer having the stay-in-place concrete footings form of claim 1 affixed thereto.

8. A concrete footer having the stay-in-place concrete footings form of claim 3 affixed thereto.

9. A concrete footer having the stay-in-place concrete footings form of claim 4 affixed thereto.

* * * * *